US008408178B2

(12) United States Patent
Xu et al.

(10) Patent No.: US 8,408,178 B2
(45) Date of Patent: Apr. 2, 2013

(54) ENGINE CRANKCASE FIRING DECK HAVING ANTI-DISTORTION PROJECTIONS

(75) Inventors: Xinmin Xu, Naperville, IL (US); Antoun Y. Calash, Elk Grove, IL (US); Naiqiang Wu, Aurora, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 911 days.

(21) Appl. No.: 12/534,943

(22) Filed: Aug. 4, 2009

(65) Prior Publication Data

US 2011/0030626 A1 Feb. 10, 2011

(51) Int. Cl.

| | |
|---|---|
| ***F02B 75/00*** | (2006.01) |
| ***F02P 1/06*** | (2006.01) |
| ***F02F 1/10*** | (2006.01) |
| ***F02F 1/00*** | (2006.01) |

(52) U.S. Cl. ..... 123/195 R; 123/193.2; 123/41.72; 123/41.85

(58) Field of Classification Search ..... 123/41.82 R, 123/41.85, 41.77, 195 R, 193.2
See application file for complete search history.

(56) References Cited

U.S. PATENT DOCUMENTS

| | | | | | |
|---|---|---|---|---|---|
| 4,131,093 | A | * | 12/1978 | Mansfield | 123/41.85 |
| 4,736,727 | A | | 4/1988 | Williams | |
| 5,035,637 | A | | 7/1991 | Mathews | |
| 5,245,970 | A | | 9/1993 | Iwaszkiewicz | |
| 5,261,357 | A | * | 11/1993 | Suh | 123/41.57 |
| 5,333,581 | A | | 8/1994 | Cagle | |
| 5,367,993 | A | | 11/1994 | Tulach | |
| 5,474,040 | A | * | 12/1995 | Murakami et al. | 123/195 R |
| 5,664,538 | A | * | 9/1997 | Hutchins | 123/195 R |
| 5,669,339 | A | * | 9/1997 | Yukawa et al. | 123/41.79 |
| 5,809,946 | A | * | 9/1998 | Abe | 123/41.74 |
| 6,295,954 | B1 | * | 10/2001 | Suzuki | 123/41.74 |
| 6,460,512 | B1 | | 10/2002 | Serio | |
| 6,484,683 | B2 | | 11/2002 | Zielke | |
| 6,886,522 | B1 | * | 5/2005 | Lawrence | 123/195 R |
| 7,322,318 | B2 | * | 1/2008 | Nagahashi et al. | 123/41.35 |
| 2005/0247294 | A1 | | 11/2005 | Rowells | |
| 2011/0030626 | A1 | * | 2/2011 | Xu et al. | 123/41.72 |

FOREIGN PATENT DOCUMENTS

JP 06213064 A * 8/1994

OTHER PUBLICATIONS

Translation for: Kotaka, Takeshi JP 06213064 A, Aug. 1994.*

* cited by examiner

*Primary Examiner* — Rinaldi Rada
*Assistant Examiner* — Tea Holbrook
(74) *Attorney, Agent, or Firm* — Mark C. Bach; Jeffrey P. Calfa

(57) ABSTRACT

A firing deck (16) for an engine crankcase includes a firing side surface (35) and a coolant side surface (34). A plurality of cylinder bores (18) are disposed through the firing deck (16) from the firing side surface (35) to the coolant side surface (34). The cylinder bores (18) form a centerline defining an intake side (26) of the firing deck (16) and an exhaust side (28) of the firing deck. A plurality of bosses (30) through the deck (16) from the firing side surface (35) to the coolant side surface (34) are disposed around each cylinder bore (18). A plurality of anti-distortion projections (36, 136) are disposed on the coolant side surface (34) of the firing deck (16) and provide the firing deck with a varied thickness. The anti-distortion projections (36, 136) are disposed on both the intake side (26) and the exhaust side (28) of the firing deck (16).

19 Claims, 3 Drawing Sheets

ENGINE CRANKCASE FIRING DECK HAVING ANTI-DISTORTION PROJECTIONS

BACKGROUND

Embodiments described herein relate to engines of vehicles. More specifically, embodiments described herein relate to firing decks of engines for vehicles.

A cylinder block and a crankcase form the main structural component of an engine, and are often cast integral with each other. The crankcase forms the housing of a crankshaft, and the cylinder block defines at least one cylinder bore, within which combustion takes place to drive the crankshaft. The cylinder bore acts as a guide and as a sealing surface for a sliding piston and rings, and as such, the cylinder bore should be accurately machined to minimize out-of-roundness.

The cylinder block includes a firing deck at a top surface of the cylinder block. Head bolts, typically four for each cylinder bore, are introduced into bosses disposed through the firing deck to attach the cylinder block to a cylinder head.

Due to the uneven distributions of both cylinder block stiffness and clamping forces developed from the placement of the head bolts through the firing deck, the cylinder bores can undergo distortion. Mathematically, the bore distortion can be decomposed into many orders, and it is known that fourth order distortion of the cylinder bores can result in increased engine oil consumption. Additionally, the gasket sealing pressures are decreased at locations between the head bolts due to the structural weakness (less stiffness) there. The decreased gasket sealing pressures can in turn lead to combustion leaks and can also lead to engine failure.

To address the distortion in conventional crankcases, the firing deck has conventionally been reinforced by filling in shake-out holes that are located on the intake side only of the firing deck, or modifying the tooling for the casting to eliminate the shake-out holes. Further, the filled-in shake-out holes have been provided with arch-formations on a bottom or coolant side surface of the firing deck at the intake side only.

The firing deck of a conventional cylinder block typically has a uniform thickness, however to address distortion and to reinforce the firing deck, areas of increased thickness have sometimes been added to an exhaust side only of the firing deck. Further, the thickness of the firing deck between the cylinder bores (generally on a line connecting the centers of adjacent cylinder bores) has sometimes been increased up to fifty percent. However, bore distortions can continue to occur in the conventional cylinder block.

SUMMARY OF THE INVENTION

A firing deck for an engine crankcase includes a firing side surface and a coolant side surface. A plurality of cylinder bores are disposed through the firing deck from the firing side surface to the coolant side surface. The cylinder bores form a centerline defining an intake side of the firing deck and an exhaust side of the firing deck. A plurality of bosses through the deck from the firing side surface to the coolant side surface are disposed around each cylinder bore. A plurality of anti-distortion projections are disposed on a coolant side surface of the firing deck and provide the firing deck with a varied thickness. The anti-distortion projections are disposed on both the intake side and the exhaust side of the firing deck.

DETAILED DESCRIPTION

Figure 1:
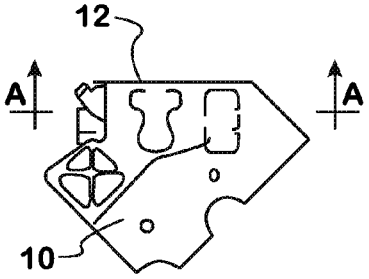
FIG. 1 is a left bank of an engine crankcase.

Referring now to FIG. 1, an integrally cast crankcase and cylinder block of an engine is indicated generally at 10, and will be herein referred to as the crankcase 10. The crankcase 10 has a V-type configuration, however it is possible that the crankcase can have other configurations. The crankcase 10 has a cylinder head (not shown) clamped by head bolts against a top surface 12 of the crankcase. A gasket (not shown) is disposed between the cylinder head and the crankcase 10 for sealing purposes.

Figure 2:
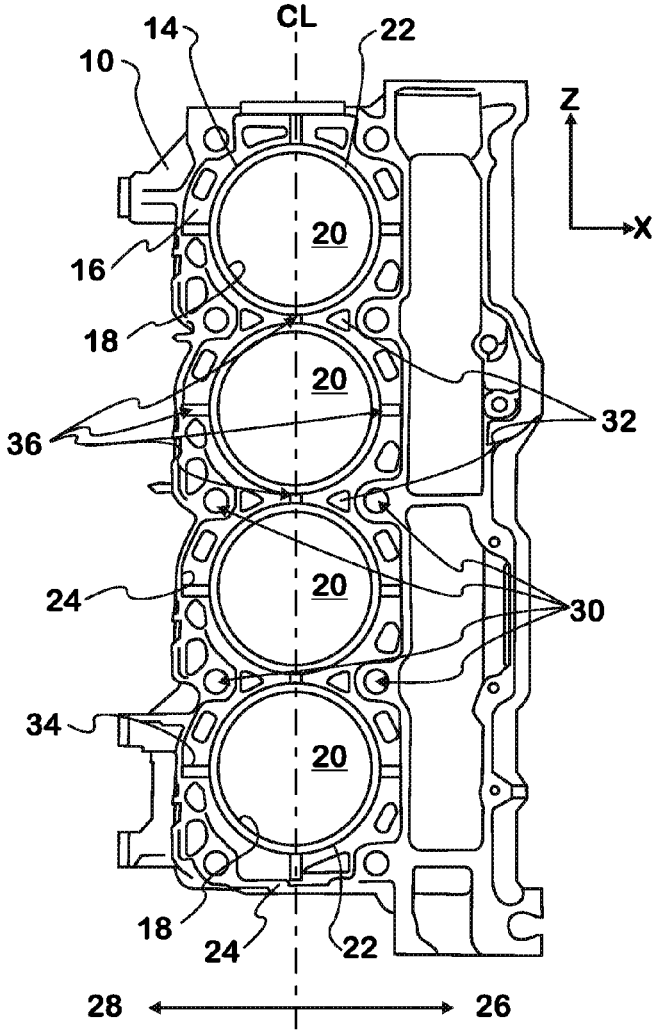
FIG. 2 is a top section view of the crankcase taken along line A-A of FIG. 1 showing a cylinder block firing deck.

Referring to FIG. 2, a firing deck 16 of the crankcase 10 is located on a top section of the crankcase 10 of FIG. 1. The firing deck 16 includes a plurality of cylinder bores 18 defining engine cylinders 20. A raised cylinder lip 22 is concentric to the cylinder bore 18, and the firing deck 16 extends generally concentrically about each cylinder 20 to a raised exterior lip 24. A deck portion 14 of the firing deck 16 extends from the raised cylinder lip 22 to the raised exterior lip 24. An intake side 26 and an exhaust side 28 of the firing deck 16 are shown in FIG. 2, and are defined with reference to a centerline CL formed by the centers of the cylinders 20.

The firing deck 16 also includes a plurality of bosses 30 disposed at generally 90-degree increments around each cylinder bore 18. With respect to the centers of the cylinders 20 in FIG. 2, the bosses 30 are at about 45-degrees, 135-degrees, 225-degrees, and 312-degrees. Head bolts (not shown) are introduced into the bosses 30 disposed through the firing deck 16 to attach the cylinder block to the cylinder head. In the firing deck 16, four bosses 30 are disposed concentrically around each cylinder bore 18, with adjacent cylinder bores sharing two bosses. In the firing deck 16 having four cylinder bores 18, there are typically ten bosses 30.

Figure 6:
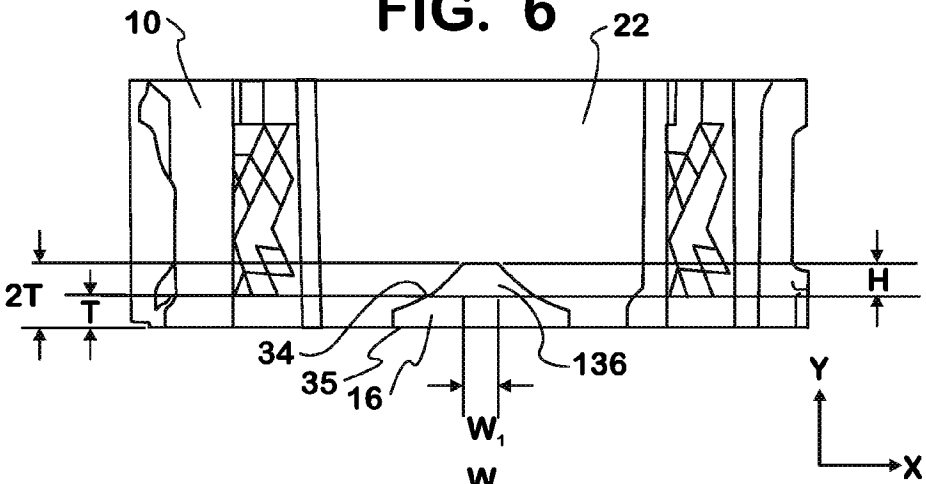
FIG. 6 is a section view of the firing deck taken along line B-B of FIG. 5.
Figure 7:
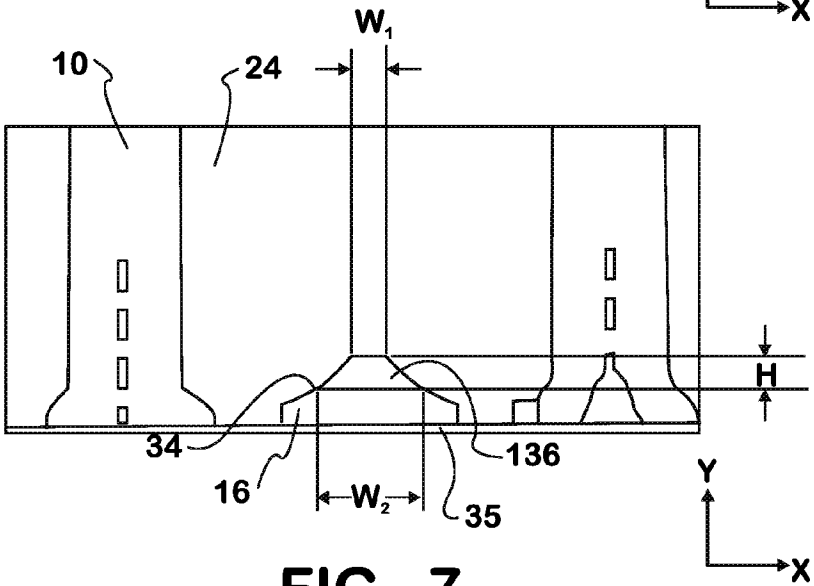
FIG. 7 is a section view of the firing deck taken along line C-C of FIG. 5.
Figure 5:
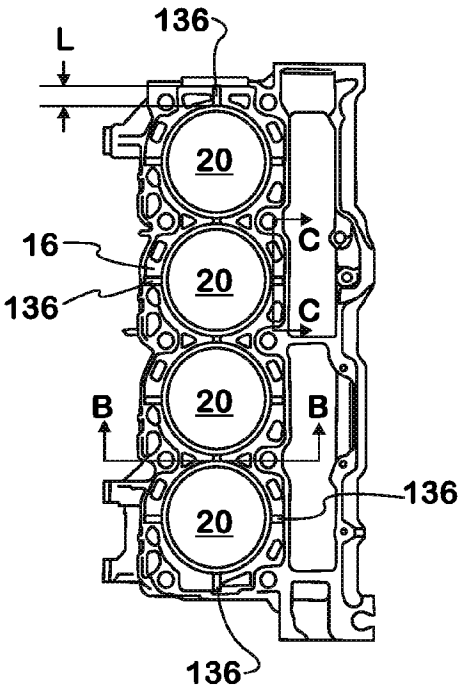
FIG. 5 is a top section view of the crankcase taken along line A-A of FIG. 1, the firing deck having variable thickness formations.

To reduce the weight and for casting purposes, the firing deck 16 may have a plurality of shake-out holes 32 and/or other formations. The firing deck 16 may additionally have transfer ducts that are provided in a coolant side surface 34 of the firing deck to permit the circulation of coolant to the cylinder head. A firing side surface 35 (FIG. 6) is opposite the coolant side surface 34. The bosses 30 and the cylinder bores 18 are disposed through the firing deck 16 and extend from the firing side surface 35 to the coolant side surface 34

Figure 4:
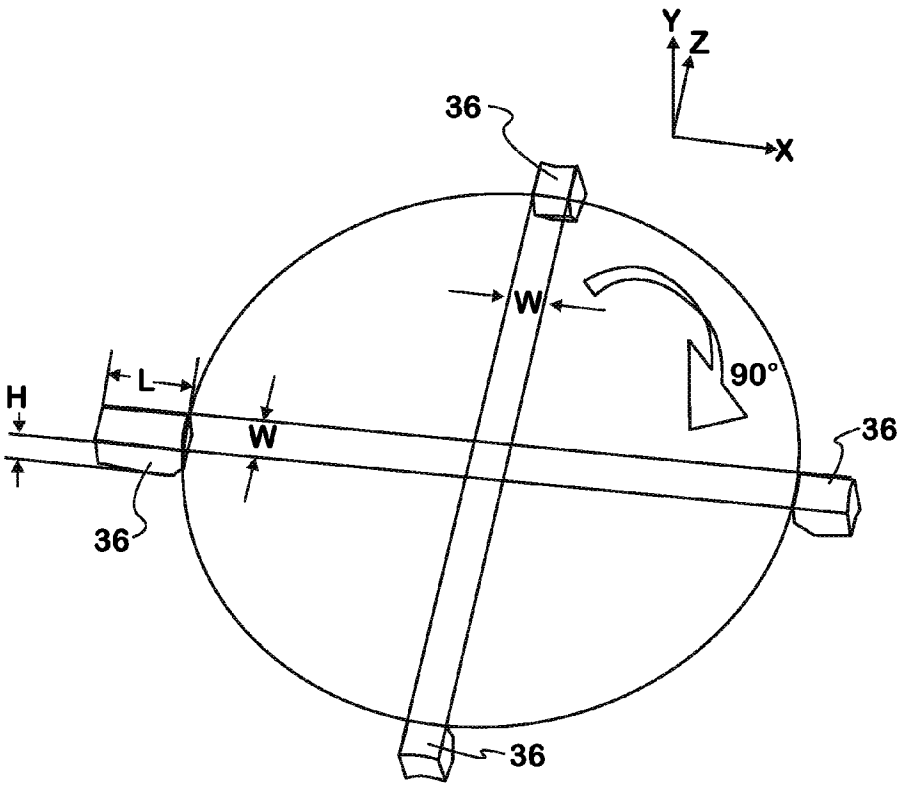
FIG. 4 is a schematic of the orientation, placement and dimensions of the gusset formations on the firing deck.
Figure 3:
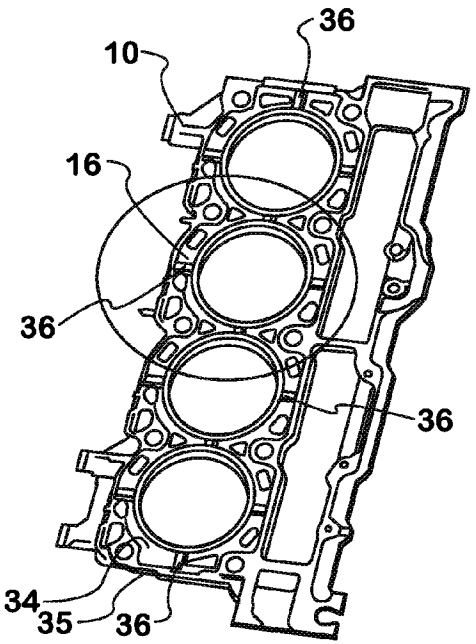
FIG. 3 is a perspective section view of the crankcase taken along line A-A of FIG. 1, the firing deck having gusset formations.

The firing deck 16 has a plurality of anti-distortion projections 36 disposed between the plurality of bosses 30. Referring to FIGS. 2-4, the anti-distortion projections are gusset formations 36 disposed between the plurality of bosses 30. In the firing deck 16 having four cylinder bores 18, there are thirteen anti-distortion projections. The gusset formations 36 can be rectangular prism-shaped, however other shapes are contemplated.

Specifically, at least one gusset formation 36 is disposed between two adjacent bosses 30. With respect to the centerline of the cylinders 20, the gusset formations 36 are located at 0-degrees, 90-degrees, 180-degrees, and 270-degrees. The gusset formations 36 are disposed on both the intake side 26 of the firing deck 16 and the exhaust side 28 of the firing deck.

Between the raised cylinder lip 22 and the raised exterior lip 24, and aside from the bosses 30 and the shake-out holes 32, the coolant side surface 34 of the deck portion 14 of the firing deck 16 is generally planar. The firing deck 16 generally has a uniform thickness at locations between the between the raised cylinder lip 22 and the raised exterior lip 24, except at the gusset formations 36, which provide locations of increased thickness of the firing deck. The gusset formations 36 are cast directly into the firing deck 16 and project from the coolant side surface 34 of the firing deck, the height H of the gusset formations providing the firing deck with a varied thickness.

The dimensions of each of the gusset formations 36 are generally the same, although it is possible that the gusset formations can differ from each other. The height H of the gusset formation 36 is generally uniform across the length L of the gusset formation, and is generally equal to the thickness of the firing deck 16, therefore generally providing the firing deck with twice the thickness in the y-axis at the location of the gusset formation. The width W of the gusset formation 36 is generally equal to the thickness of the firing deck 16 plus 1 mm. The length L of the gusset formations 36 on the intake side 26 and the exhaust side 28 generally extend from the raised cylinder lip 22 to the raised exterior lip 24. The gusset formations 36 located generally on the centerline of the cylinders 20 and at the interior of the firing deck generally extend from one raised cylinder lip 22 to the adjacent raised cylinder lip, and the gusset formations located on the centerline of the cylinders 20 and at the exterior generally extend from the raised cylinder lip to the raised exterior lip 24.

Referring now to FIGS. 2 and 5-7, a second embodiment of anti-distortion projection is a trapezoid formation 136 having varying thickness T across the width $W_2$ of the trapezoid formation. Specifically, at least one trapezoid formation 136 is disposed between two adjacent bosses 30. With respect to the center of the cylinders 20, the trapezoid formations 136 are located at 0-degrees, 90-degrees, 180-degrees, and 270-degrees. The trapezoid formations 136 are disposed on both the intake side 26 of the firing deck 16 and the exhaust side 28 of the firing deck.

While a conventional firing deck 16 generally has a uniform thickness at locations between the cylinder bores 18, the bosses 30, and the shake-out holes 32, the trapezoid formations 136 provide locations of increased and varying thickness of the firing deck. The trapezoid formations 136 are cast directly into the firing deck 16 and project from the coolant side surface 34 of the firing deck.

The trapezoid formation 136 has a top width $W_1$ that is generally equal to the thickness of the firing deck 16 minus 1 mm, and a bottom width $W_2$ that is generally equal to three-times the $W_1$. The height H of the trapezoid formation 136 is generally equal to the thickness T of the firing deck 16. With respect to the y-axis, the trapezoid formation 136 provides the firing deck 16 with twice the thickness 2T over the top width $W_1$ of the trapezoid formation, and decreasing from twice the thickness 2T to no additional thickness T over the width $W_2$ minus $W_1$.

Other shapes and dimensions of anti-distortion projections 136 that have varying thickness across the length L or across the width $W_2$ are possible. The firing deck 16 with anti-distortion projections 36, 136 may be formed of cast iron or aluminum alloy, however other materials are contemplated.

With the anti-distortion projections 36, 136, the improvements in fourth order distortion of the cylinder bore 18 over conventional uniform firing decks 16 can range from about a 20% improvement to about a 45% improvement, depending on the cylinder bores. Specifically, testing has shown that the improvement in fourth order distortions are improved by about 24% for the middle bores and about 43% for the end bores. Improvement of second order and third order distortion may also be realized with the anti-distortion projections 36, 136. Additionally, with the anti-distortion projections 36, 136, the minimum gasket sealing pressure between cylinders 20 is increased from about 131 MPa to about 140 MPa.

What is claimed is:

1. A firing deck for an engine crankcase, the firing deck comprising:

a firing side surface;

a coolant side surface opposite the firing side surface;

a plurality of cylinder bores through the firing deck from the firing side surface to the coolant side surface, the cylinder bores forming a centerline defining an intake side of the firing deck and an exhaust side of the firing deck;

a plurality of bosses through the firing deck from the firing side surface to the coolant side surface, and disposed around each cylinder bore;

a plurality of anti-distortion projections disposed on the coolant side surface of the firing deck and providing the firing deck with a varied thickness, wherein the anti-distortion projections are disposed on both the intake side and the exhaust side of the firing deck, wherein each cylinder bore has four bosses disposed generally concentrically about the cylinder bore, and at least one anti-distortion projection is disposed between each boss.

2. The firing deck of claim 1 wherein the anti-distortion projections are gusset formations having a generally uniform height over a length of the gusset formation.

3. The firing deck of claim 2 wherein the gusset formations are rectangular prisms.

4. The firing deck of claim 1 wherein the anti-distortion projections are trapezoid formations having a varying height over a width of the trapezoid formation.

5. The firing deck of claim 1 wherein the four bosses are located about 90-degrees from each other, and the anti-distortion projections are located about 90-degrees from each other.

6. The firing deck of claim 1 wherein all of the plurality of anti-distortion projections have the same dimensions.

7. The firing deck of claim 1 wherein the plurality of anti-distortion projections are located about each of the plurality of cylinders at 0-degrees, 90-degrees, 180-degrees, and 270-degrees with respect to the centerline.

8. The firing deck of claim 1 wherein the plurality of anti-distortion projections are cast into the firing deck.

9. The firing deck of claim 1 wherein the plurality of cylinder bores comprises four cylinder bores, and the plurality of anti-distortion projections comprises thirteen anti-distortion projections.

10. A firing deck for an engine crankcase, the firing deck comprising:

a generally planar firing side surface and a coolant side surface opposite the firing side surface;

a plurality of cylinder bores through the firing deck from the firing side surface to the coolant side surface;

a plurality of bosses through the firing deck from the firing side surface to the coolant side surface and disposed around each cylinder bore;

a plurality of gusset formations disposed on the coolant side surface of the firing deck around each of the plurality of cylinder bores, at least one gusset formation is disposed between each of the plurality of bosses, wherein the plurality of gusset formations provide the firing deck with a varied thickness.

11. The firing deck of claim 10 wherein the plurality of gusset formations are rectangular prisms.

12. The firing deck of claim 10 wherein each of the plurality of cylinder bores has four bosses disposed generally concentrically about the cylinder bore.

13. The firing deck of claim 10 wherein the dimensions of each of the plurality of gusset formations are generally the same.

14. The firing deck of claim 13 wherein each of the plurality of gusset formations has a height that is generally equal to the thickness of the firing deck, and a width that is generally equal to the thickness of the firing deck plus 1 mm.

15. A firing deck for an engine crankcase, the firing deck comprising:

a generally planar firing side surface and a coolant side surface opposite the firing side surface;

a plurality of cylinder bores through the firing deck from the firing side surface to the coolant side surface;

a plurality of bosses through the firing deck from the firing side surface to the coolant side surface and disposed around each cylinder bore;

a plurality of bosses through the firing deck and disposed around each cylinder bore;

at least one trapezoid formation disposed on the coolant side surface of the firing deck and located between two of the plurality of bosses, wherein the at least one trapezoid formation provides the firing deck with a varied thickness.

16. The firing deck of claim 15 wherein each of the plurality of cylinder bores has four bosses disposed generally concentrically about the cylinder bore.

17. The firing deck of claim 16 wherein the at least one trapezoid formation comprises a plurality of trapezoid formations, and wherein at least one of the plurality of trapezoid formations is disposed between each of the four bosses.

18. The firing deck of claim 17 wherein the cylinder bores define a centerline, and wherein the plurality of trapezoid formations are located about each of the plurality of cylinders at 0-degrees, 90-degrees, 180-degrees, and 270-degrees with respect to the centerline.

19. The firing deck of claim 15 wherein the at least one trapezoid formation has a top width that is generally equal to the thickness of the firing deck minus 1 mm, a bottom width that is generally equal to three-times the bottom width, and a height that is generally equal to the thickness of the firing deck.

* * * * *